US010895367B1

(12) United States Patent
Bloom et al.

(10) Patent No.: US 10,895,367 B1
(45) Date of Patent: Jan. 19, 2021

(54) DECORATIVE OUTDOOR LIGHT

(71) Applicants: Michael Bloom, Lawrence, KS (US); Melissa Bloom, Lawrence, KS (US)

(72) Inventors: Michael Bloom, Lawrence, KS (US); Melissa Bloom, Lawrence, KS (US)

( * ) Notice: Subject to any disclaimer, the term of this patent is extended or adjusted under 35 U.S.C. 154(b) by 0 days.

(21) Appl. No.: 16/747,629

(22) Filed: Jan. 21, 2020

(51) Int. Cl.

| | |
|---|---|
| ***F21V 3/00*** | (2015.01) |
| ***F21V 5/00*** | (2018.01) |
| ***F21V 17/08*** | (2006.01) |
| ***F21V 3/06*** | (2018.01) |
| *F21W 121/00* | (2006.01) |

(52) U.S. Cl.
CPC ..... *F21V 17/08* (2013.01); *F21V 3/061* (2018.02); *F21V 3/062* (2018.02); *F21W 2121/00* (2013.01)

(58) Field of Classification Search
CPC ..... F21V 3/06–0625; F21V 17/04–08; F21V 17/12; F21W 2121/00; F21W 2121/004–04
USPC ..... 362/121–123, 249.06, 249.14–249.19, 362/311.13, 565–568, 652–654, 806–807
See application file for complete search history.

(56) References Cited

U.S. PATENT DOCUMENTS

| | | | | |
|---|---|---|---|---|
| 5,567,045 | A | 10/1996 | Bucek | |
| 10,184,654 | B1 * | 1/2019 | Chen | F21V 33/0028 |
| 2006/0215410 | A1 | 9/2006 | Mitchell | |
| 2008/0175006 | A1 * | 7/2008 | Kellmann | F21S 9/037 362/360 |
| 2013/0322061 | A1 * | 12/2013 | Carpenter | F21S 4/10 362/123 |

* cited by examiner

*Primary Examiner* — Jason M Han
(74) *Attorney, Agent, or Firm* — Sanchelima & Associates, P.A.; Christian Sanchelima; Jesus Sanchelima

(57) ABSTRACT

A decorative light system including a decorative light assembly and a light fixture assembly is disclosed. The decorative light assembly includes a decorative design that may be customized as per the wishes of the user. Thereby allowing the user to express their creativity and personality. The decorative design may include lighting to illuminate the decorative design and the surrounding area. The decorative design includes a screw in power cord that is connected to an existing light socket of a light fixture. Depending upon the decorative design, the lighting illuminates the entire decorative design, an outline of the decorative design or select parts of the decorative design. Once connected, the decorative design is secured to the light fixture with fastening members. This then allows the user to decorate the lights around their home, both indoors and outdoors. The decorative light system allows for quick and easy beautification.

15 Claims, 6 Drawing Sheets

DECORATIVE OUTDOOR LIGHT

BACKGROUND OF THE INVENTION

1. Field of the Invention

The present invention relates to a decorative outdoor light and, more particularly, to a decorative outdoor light that includes a decorative design and connects to a light socket to illuminate the decorative design.

2. Description of the Related Art

Several designs for decorative outdoor lights have been designed in the past. None of them, however, include the ability to utilize power via a screw-in power cord and hook and loop straps for attaching the device to a lamp, preferably to the front of the lamp. The present invention allows for decorating the outdoor light fixtures with different designs that may preferably correspond with holidays and/or other special occasions. The present invention makes use of existing light sockets as the source for powering the lights within the present invention. Further, the designs may be entirely customizable as per the needs and wishes of the user.

Applicant believes that a related reference corresponds to U.S. patent No. 2006/0215410 for a floodlight-supported decorative body and mount system. Applicant believes another related reference corresponds with U.S. Pat. No. 5,567,045 for decorative light fixture covers for indoor and outdoor lights. None of these references, however, teach of the use of a power cord that can connect to light sockets and further none teach of the use of hook and loop straps for securing and mounting the present invention to a necessary surface. The present invention allows a user to express their personality and creativity.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a decorative light system that allows a user to express their creativity and personality.

It is another object of this invention to provide a decorative light system that can be connected to light sockets.

It is an object of the present invention to provide a decorative light system that can be retrofitted onto existing light fixtures.

It is still another object of the present invention to provide a decorative light system that includes interchangeable and countless designs.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
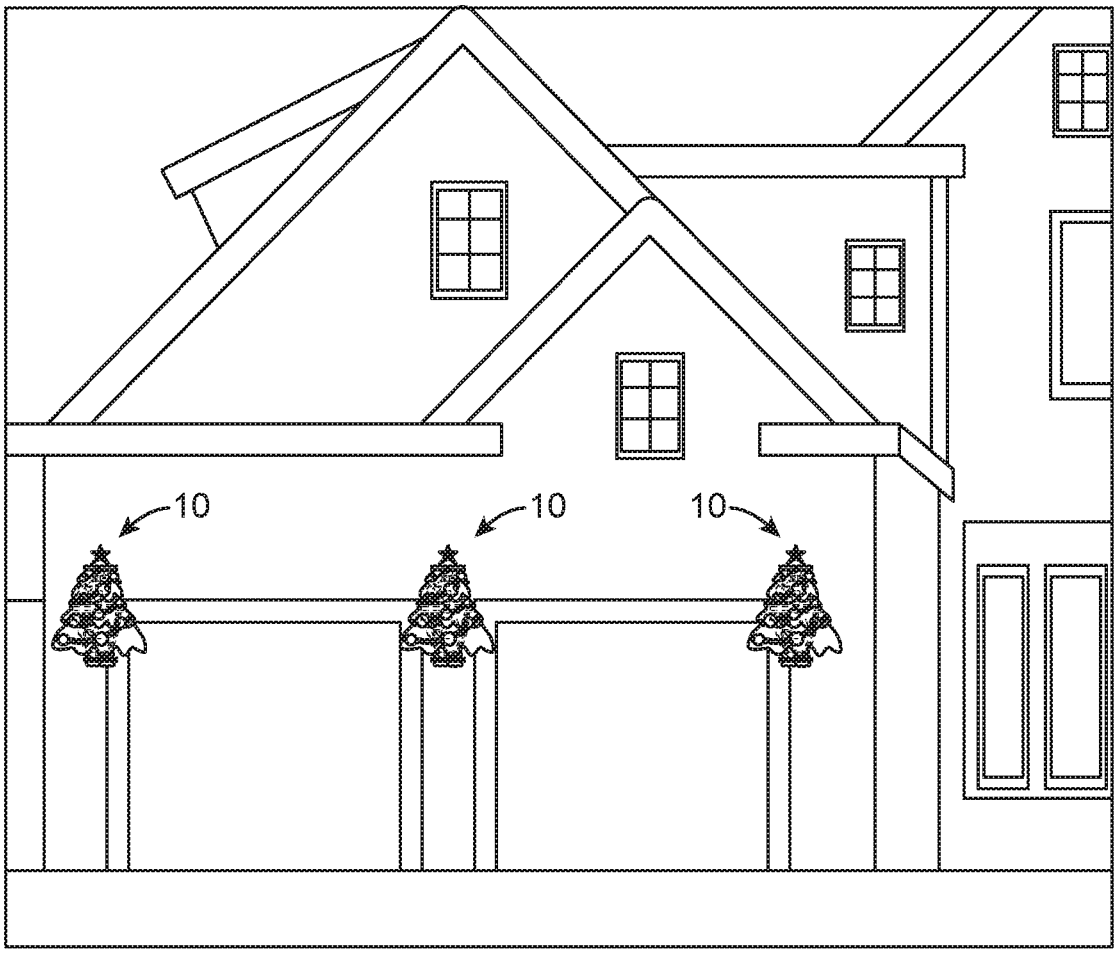
FIG. 1 represents an operational view showing the light fixture assembly 40 having the decorative light assembly 20 mounted thereto.
Figure 2:
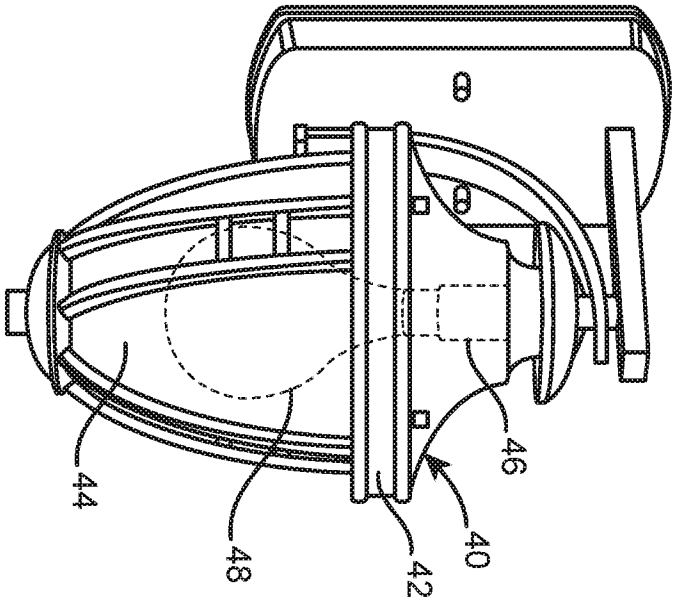
FIG. 2 represents the light fixture assembly 40 before the decorative light assembly 20 is mounted thereto.
Figure 3:
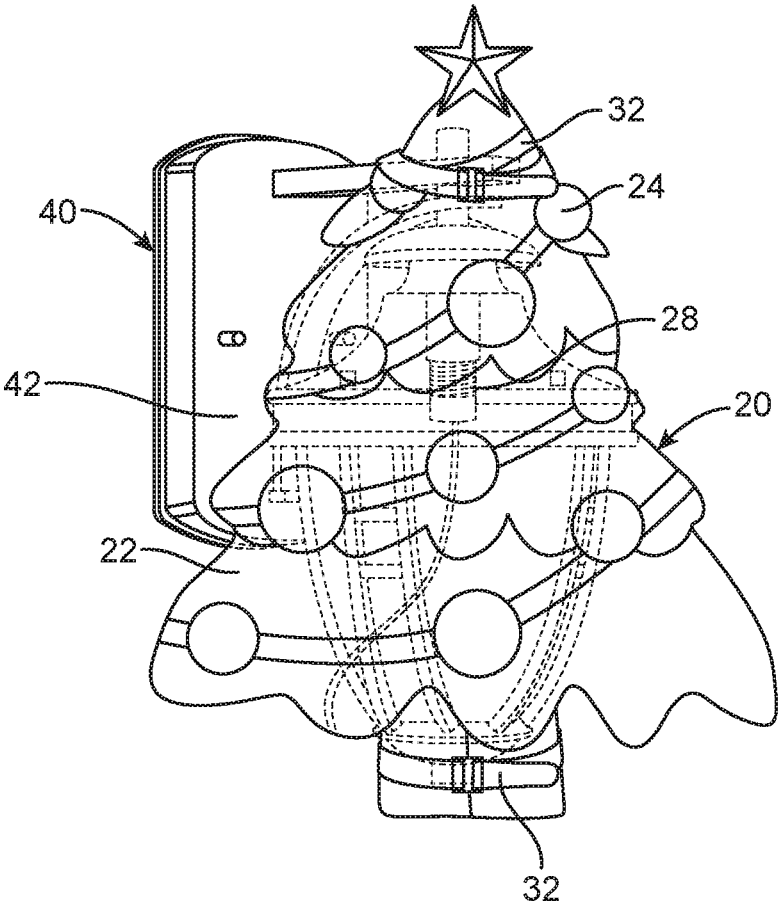
FIG. 3 represents the light fixture assembly 40 after the decorative light assembly 20 has been mounted thereto.
Figure 4:
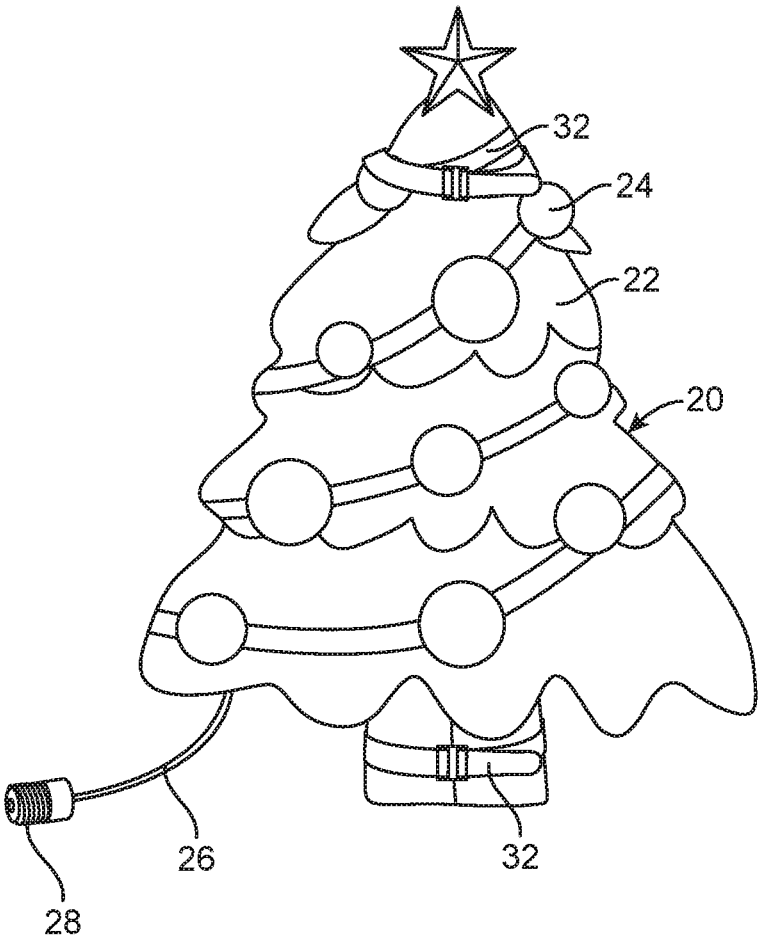
FIG. 4 shows an isometric view of the decorative light assembly 20.

Referring now to the drawings, where the present invention is generally referred to with numeral 10, it can be observed that it, a decorative light system 10, basically includes a decorative light assembly 20 and a light fixture assembly 40. Decorative light system 10, as illustrated in FIG. 1 through FIG. 6, can be used to beautify and decorate a home. The present invention allows a user to express their creativity and personality by being entirely customizable. It may be suitable to display different designs during different seasons or holidays for some users. The present invention may further be retrofitted onto existing lighting systems with ease. Referring to FIG. 2 and FIG. 3, it can be seen how light fixture 40 appears before and after, respectively, decorative light assembly 20 has been mounted thereto.

Figure 5:
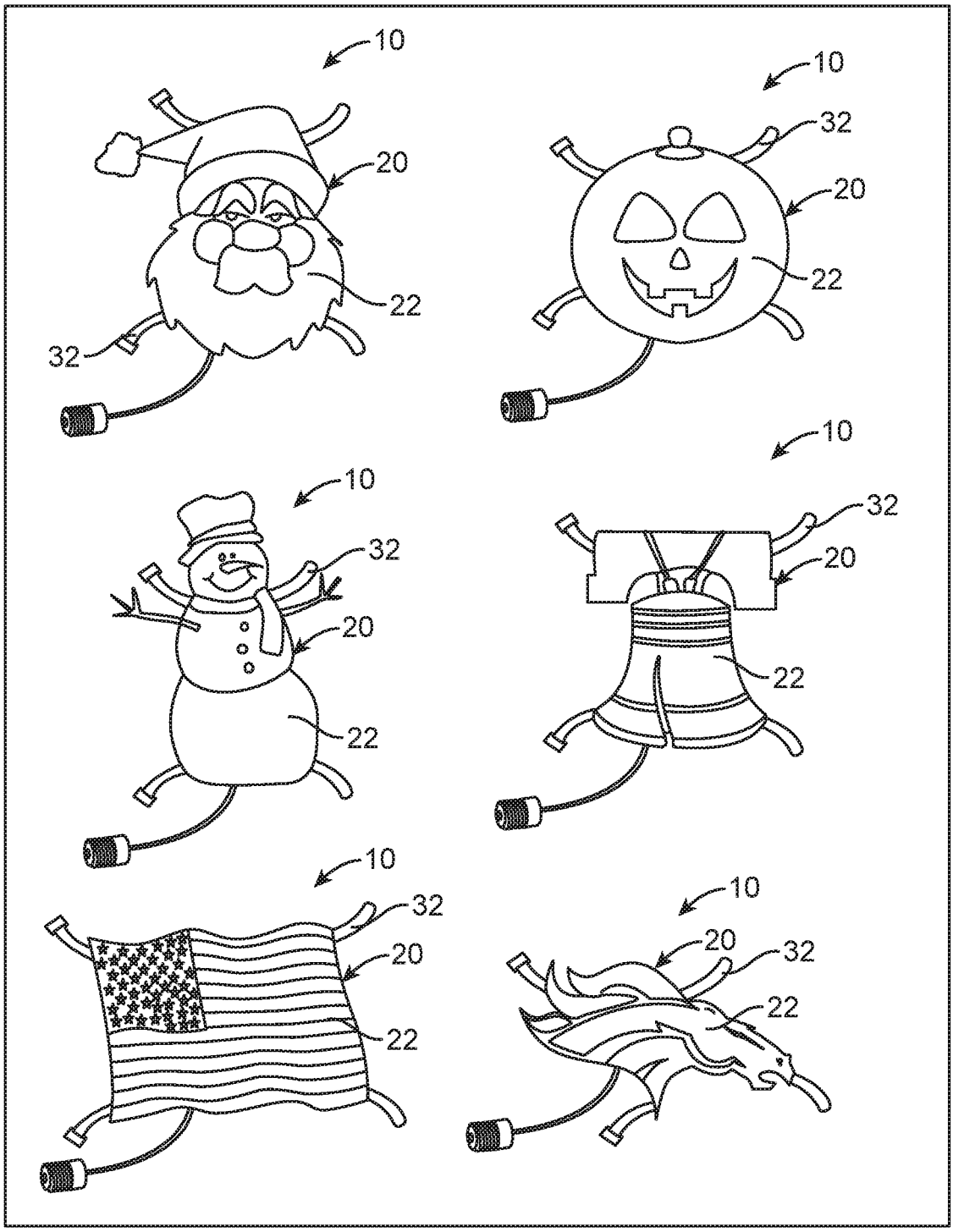
FIG. 5 illustrates examples of different decorative designs 22 that may be used with the decorative light system 10.

Decorative light assembly 20 may allow for the decorating of existing light systems. Decorative light assembly 20 includes decorative design 22. Decorative design 22 may be fully customized by the user. Decorative design 22 may be any design that the user wishes or can think of, as illustrated in FIG. 5. For example, in one embodiment, decorative design 22 may be a Christmas tree. While in another embodiment, decorative design 22 may be a ghost, for example. Decorative design 22 may be what allows the user to express their creativity and personality. Decorative design 22 may also allow for beautifying and decorating of a location such as a house. Being that decorative design 22 may be entirely customized, it is to be understood that decorative design 22 may be of a predetermined shape, color, material and dimensions. It may be suitable for decorative design 22 to be made of plastic, glass, or combinations thereof. Other materials may be suitable for decorative design 22 depending on the needs of the user. Importantly, decorative design 22 may be illuminated or emit light. As such decorative design 22 may include lighting 24. Lighting 24 may be any light means that can illuminate and emit light. Lighting 24 may be a light bulb, a plurality of bulbs, a light strip or other suitable and similar lighting means. Lighting 24 may be LED lights, in one embodiment. It may also be suitable for lighting 24 to be incandescent lights, in an alternate embodiment. In one embodiment, decorative design 22 may have lighting 24 within to entirely illuminate decorative design 22. In an alternate embodiment, lighting 24 may extend about the perimeter of decorative design 22, causing only an outline of decorative design 22 to be illuminated. In another embodiment, lighting 24 may be placed on predetermined locations on decorative design 22 which causes only select portions of decorative design 22 to illuminate. It should be understood that lighting 24 may be integral with decorative design 22. It should be understood that lighting 24 may also be configured to the liking of the user. Lighting 24 may emit light of a predetermined color as desired by the user. It may also be suitable for lighting 24 to flash or to be constantly lit and illuminated. Lighting 24 may illuminate in a predetermined pattern as well. It may also be suitable for lighting 24 to change colors automatically or to cycle through predetermined colors. Lighting 24 allows for the user to further be able to customize the present invention. It may be suitable for the present invention to include a controller or mobile application that can be used to control, configure and operate lighting 24. It should be understood that decorative light assembly 20 may further include a power cord 26 and a power socket 28 that may be attached to decorative design 22 and lighting 24. Together, power cord 26 and power socket 28 may create a screw-in power cord. Power cord 26 and power socket 28 may be adapted to provide power to lighting 24 from a power source. Power cord 26 may be an electrical wire or cable. Power socket 28 may be attached to power cord 26 at a distal end thereof. Decorative light assembly 20 may further include fastening members 32. Fastening members 32 may be adapted to allow mounting of decorative light assembly 20, more specifically, decorative design 22 where desired by the user. Fastening members 32 may preferably be hook and loop straps. However, it should be understood that alternatively, fastening members 32 may be fasteners, buttons, snap buttons, adhesives, screws, nails, or other similar means as known in the art. Fastening members 32 permit decorative design 22 to be removably mounted to light fixture assembly 40. In an alternate embodiment, decorative light assembly 20 may include speakers to emit predetermined sounds or songs. It should also be understood that preferably, decorative design 22 may be made of materials that are heat resistant for added safety to the user to make sure that light 24 does not cause decorative design 22 to catch fire and burn up.

Light fixture assembly 40 may cooperate with decorative light assembly 20. Light fixture assembly 40 may include a light fixture 42 which includes a light cover 44 and a light socket 46. It should be understood that decorative light assembly 20 may be retrofitted onto existing of light fixture 42. To mount decorative light assembly 20 to light fixture assembly 40 the following steps must be taken. Firstly, light cover 44 must be removed from light fixture 42. Afterwards, a light bulb 48 connected to light socket 46 should be removed. Subsequently, power socket 28 may be attached to light socket 46, resulting in decorative light assembly 20 being connected to a power source. Preferably, power socket 28 may be screwed into or rotated into light socket 46. At this point, it may be suitable to reattach light cover 44 to light fixture 42. However, it may be suitable to leave light cover 44 detached from light fixture 42 once decorative light assembly 20 has been connected to light socket 46. Decorative design 22 may then be secured in place to finish the decorating desired by the user. More specifically, decorative design 22 may be secured to light fixture 42 with fastening members 32. Decorative design 22 may preferably be mounted in front of light fixture 42. Fastening members 32 may maintain decorative design 22 in place over light fixture 42 until desired. Fastening members 32 allow for removably attaching decorative light assembly 20 to light fixture assembly 40. It may be suitable for the present invention to include actuating means on decorative assembly 20 to power on and off lighting 24. However, preferably, lighting 24 is powered on and off by the same actuating means that previously powered on and off light fixture 42. In an alternate embodiment, decorative design 22 may entirely go over and cover light fixture 42 before being secured by fastening members 32.

Figure 6:
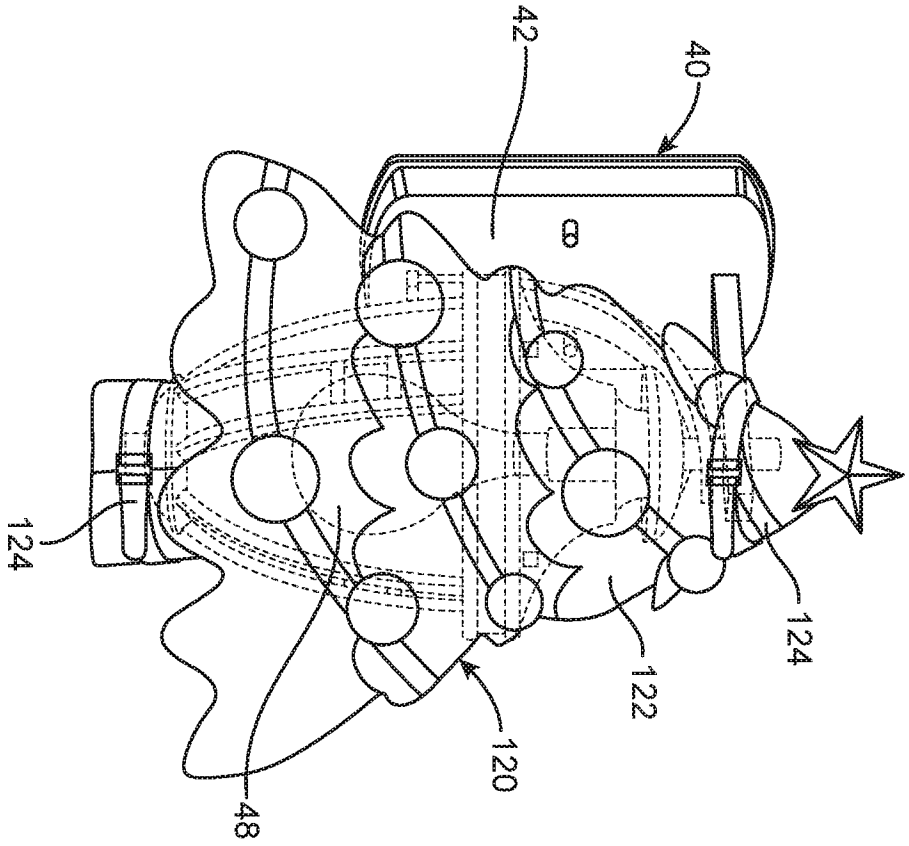
FIG. 6 shows an alternate embodiment, in which decorative light assembly 122 is mounted to light fixture assembly 40 for illuminating of decorative design 122.

In an alternate embodiment, as seen in FIG. 6, the present invention may include a decorative light assembly 120 that cooperates with light fixture assembly 40. Decorative light assembly 120 may include a decorative design 122 similar to decorative design 22. Additionally, decorative assembly 120 may include fastening members 124 to secure decorative design 122 to light fixture 42. The main distinction between decorative light assembly 20 and decorative light assembly 120 being that there is no native lighting on decorative light assembly 120. Instead, decorative light assembly 120 makes use of light bulb 48 to illuminate decorative design 122. Light fixture assembly 40 remains intact and untouched when used with decorative light assembly 120. It may be suitable for decorative design 122 to be mounted in front of light fixture 42 or to be mounted entirely over and covering light fixture 42. Decorative design 122 may be entirely illuminated by light bulb 48. The light effects for decorative design 122 may depend on the light effects capable by light bulb 48. Decorative design 122 may be entirely customized and of predetermined shapes, designs, colors, or dimensions as desired by the user. Examples can be similar as those for decorative light assembly 20 as shown in FIG. 5. Decorative light assembly 120 may be less costly, more light weight and durable than decorative light assembly 20 as there are fewer components and advantageously no electrical components within. It should be noted that, preferably, decorative design 122 may be made of materials that are resistant to heat and fire so that light bulb 48 does not cause decorative design 122 to catch fire and burn which could lead to injury.

The present invention, in any embodiment, helps to decorate a location such as a house. It may be suitable to mount the present invention to light fixtures which are indoors or outdoors. The user can express their creative side and customize their decorations with the present invention.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A decorative lighting system comprising:

a. a decorative light assembly including a decorative design having lighting, said decorative light assembly further including a screw in power cord defined by a power cord and a power socket, said power cord and power socket mounted to said decorative design, said decorative light assembly also including fastening members;

b. a light fixture assembly including a light fixture having a light socket; and c. said power cord and said power socket extending rearwardly and connected to said light socket adapted to provide a power source for said lighting, said decorative design mounted and secured in abutting contact in front of said light fixture with said fastening members, said decorative design concealing said light fixture, said decorative design includes a top end and a bottom end, said fastening members include a top strap configuration and a bottom strap configuration, said light fixture includes a fixture top end and a fixture bottom end, said top strap configuration wraps entirely around said fixture top end and said bottom strap configuration wraps entirely around said fixture bottom end thereby securing said decorative design to said light fixture, said top strap configuration forming a top ring around said fixture top end in a closed position, said bottom strap configuration forming a bottom ring around said fixture bottom end in said closed position, said light fixture being entirely behind said decorative design.

2. The system of claim 1, wherein said decorative design is customizable.

3. The system of claim 1, wherein lighting is inside of said decorative design.

4. The system of claim 1, wherein said lighting is about a perimeter of said decorative design.

5. The system of claim 1, wherein said lighting is integral with said decorative design and illuminates select portions of said decorative design.

6. The system of claim 1, wherein said lighting flashes in predetermined patterns.

7. The system of claim 1, wherein said lighting is LED lights or incandescent lights.

8. The system of claim 1, wherein said decorative design is made of plastic, glass or combinations thereof.

9. The system of claim 1, wherein said lighting emits light in predetermined colors.

10. The system of claim 1, wherein said power socket is rotated into said light socket.

11. The system of claim 1, wherein said fastening members are one of hook and loop straps, adhesives, fasteners, snap buttons, or combinations thereof.

12. The system of claim 1, wherein said fastening members are parallel to each other.

13. A decorative lighting system consisting of:

a. a decorative light assembly including a decorative design having lighting, said decorative light assembly further including a screw in power cord defined by a power cord and a power socket, said power cord mounted to said decorative design, said power socket being at a distal end of said power cord, said decorative light assembly also including hook and loop straps, said decorative design being customizable, said lighting being of a predetermined color, said hook and loop straps being at a top end and a bottom end of said decorative design, said hook and loop straps being parallel to each other;

b. a light fixture assembly including a light fixture having a light socket; and c. said power socket extending rearwardly and connected to said light socket through a rotation of said power socket, said light socket adapted to provide a power source for said lighting, said decorative design mounted and secured in abutting contact in front of said light fixture with said hook and loop straps, said light fixture being entirely behind said decorative design, said decorative design concealing said light fixture.

14. The system of claim 13, wherein said lighting flashes in predetermined patterns.

15. The system of claim 13, wherein said lighting emits light constantly.

* * * * *